US008701927B2

(12) United States Patent
Rubner et al.

(10) Patent No.: US 8,701,927 B2
(45) Date of Patent: Apr. 22, 2014

(54) NANOPARTICLE THIN-FILM COATINGS FOR ENHANCEMENT OF BOILING HEAT TRANSFER

(75) Inventors: Michael F. Rubner, Westford, MA (US); Jacopo Buongiorno, Burlington, MA (US); Lin-wen Hu, Lexington, MA (US); Eric Christopher Forrest, Berlin, MA (US); Erik Howard Williamson, Somerville, MA (US); Robert E. Cohen, Jamaica Plain, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 505 days.

(21) Appl. No.: 12/703,228

(22) Filed: Feb. 10, 2010

(65) Prior Publication Data

US 2010/0224638 A1 Sep. 9, 2010

Related U.S. Application Data

(60) Provisional application No. 61/151,586, filed on Feb. 11, 2009.

(51) Int. Cl.
*F22B 37/00* (2006.01)
*B05D 3/02* (2006.01)

(52) U.S. Cl.
USPC ..... 220/660; 427/372.2; 427/384

(58) Field of Classification Search
CPC ..... B65D 1/40; B05D 3/02; B05D 1/36; B05D 1/12; B32B 3/00; B32B 33/00; B32B 15/16; B32B 18/00
USPC ..... 220/660; 427/372.2, 384, 409, 427/388.1–388.5, 226; 276/461, 412
See application file for complete search history.

(56) References Cited

U.S. PATENT DOCUMENTS 4,171,350 A * 10/1979 Sanders ..... 423/580.1
5,295,169 A * 3/1994 Tominaga et al. ..... 376/293
7,022,416 B2 * 4/2006 Teranishi ..... 428/601

(Continued)

FOREIGN PATENT DOCUMENTS

JP 2008-164279 7/2008

OTHER PUBLICATIONS

Korean Intellectual Property Office, International Search Report and Written Opinion for PCT/US2010/023733 (corresponding PCT application) (Dec. 6, 2010).

(Continued)

*Primary Examiner* — Andrew Perreault
(74) *Attorney, Agent, or Firm* — Modern Times Legal; Robert J. Sayre

(57) ABSTRACT

A superhydrophilic thin film is formed on a metal surface of a boiler vessel to alter the wettability and roughness of the surface, which, in turn, changes the boiling behavior at the surface. The superhydrophilic film is formed by depositing a layer of a first ionic species on the surface from a solution. A second ionic species having a charge opposite to the that of the first ionic species is then deposited from solution onto the surface to produce a bilayer of the first ionic species and the oppositely charged second ionic species. The depositions are then repeated to form a plurality of bilayers, on top of the preceding bilayer. The bilayers are then heated, leaving the second ionic species on the metal surface to form a superhydrophilic film.

11 Claims, 3 Drawing Sheets

(56) References Cited

U.S. PATENT DOCUMENTS

| | | | | |
|---|---|---|---|---|
| 2007/0036959 | A1* | 2/2007 | Yamato et al. | 427/372.2 |
| 2007/0104922 | A1 | 5/2007 | Zhai et al. | |
| 2007/0166513 | A1 | 7/2007 | Sheng et al. | |
| 2008/0038458 | A1 | 2/2008 | Gemici et al. | |
| 2008/0268229 | A1 | 10/2008 | Lee et al. | |
| 2010/0034335 | A1* | 2/2010 | Varanasi et al. | 376/412 |

OTHER PUBLICATIONS

Bang, C., et al., "Boiling heat transfer performance and phenomena of AI2O3-water nano-fluids from a plain surface in a pool", International Journal of Heat and Mass Transfer, vol. 48, Issue 12, pp. 2407-2419 (Jun. 2005).

Bravo, Javier, et al., "Transparent Superhydrophobic Films Based on Silica Nanoparticles", 23 Langmuir 7293, pp. 7293-7298 (2007).

Decher, G., et al., "Buildup of ultrathin multilayer films by a self-assembly process", 46 Macromolecular Chemie-Macromolecular Symposia 321, pp. 1430-1434 (1991).

Cebeci, F.C., et al., "Nanoporosity-driven superhydrophilicity : A means to create multifunctional antifogging coatings", 22 Langmuir 2856-2856 (2006).

Gemici, Zekeriyya, et al., "Hydrothermal Treatment of Nanoparticle Thin Films for Enhanced Mechanical Durability", 24 Langmuir 2168-2177 (2008).

Kim, Hyungdae, et al., "Experimental study on CHF characteristics of water-TiO2 nano-fluids", 36 Nuclear Engineering and Technology 61 (2006).

Kim, S. J., et al., "Surface wettability change during pool boiling of nanofluids and its effect on critical heat flux", 50 International Journal of Heat and Mass transfer 4105-4116 (2007).

Lee, Daeyeon, et al., "All-Nanoparticle Thin-Film Coatings", 6 Nano Letters 2305 (2006).

Lee, D., et al., "Multilayers of Oppositely Charged SiO2 Nanoparticles: Effect of Surface Charge on Multilayer Assembly", 23 Langmuir 8833-37 (2007).

Milanova, D., et al., "Role of ions in pool boiling heat transfer of pure and silica nanofluids", 87 Applied Physics Letters 233107 (2005).

Vassallo, P., et al., "Pool boiling heat transfer experiments in silica-water nano-fluids", 47 International Journal of Heat and Mass Transfer 407-411(2004).

You, S. M., et al., "Effect of nanoparticles on critical heat flux of water in pool boiling heat transfer", 83 Applied Physics Letters 3374 (2003).

Zhai, L., et al., "Patterned Superhydrophobic Surfaces: Toward a Synthetic Mimic of the Namib Desert Beetle", 6 Nano Letters 1213-17 (2006).

* cited by examiner

NANOPARTICLE THIN-FILM COATINGS FOR ENHANCEMENT OF BOILING HEAT TRANSFER

GOVERNMENT SUPPORT

This invention was made with government support under Grant No. DMR0213282 awarded by the National Science Foundation. The government has certain rights in the invention.

RELATED APPLICATION

This application claims the benefit of U.S. Provisional Application No. 61/151,586, filed Feb. 11, 2009, the entire content of which is incorporated herein by reference.

BACKGROUND

Nucleate boiling is a very effective heat-transfer mechanism, as it can realize high rates of energy transport with minimal temperature drop across engineering surfaces. Nucleate boiling, however, is limited by the critical value of the heat flux (CHF) at which a transition to a deteriorated boiling mode, called film boiling, occurs. In practical applications of boiling, it is desirable to have a high heat-transfer coefficient, and maintaining the operating heat flux below the CHF is advantageous. A high CHF value is also desirable because, everything else being the same, the allowable power density that can be handled by a device based on nucleate boiling is roughly proportional to the CHF. To a first approximation, a 50% increase of the CHF can, therefore, result in 50% higher power density or, equivalently, 50% more-compact cooling systems for electronic devices, nuclear and chemical reactors, refrigeration systems, boilers, etc., with performance and economic benefits in all these applications.

Ways to increase the boiling heat transfer coefficient and CHF have been explored for decades; approaches include, e.g., surface micro-machining and surface coating to increase the number of bubble nucleation sites or use of surfactants to control surface tension. A recent approach that builds on the opportunities created by the rapid expansion of nanotechnology includes seeding the boiling fluid of choice with nanoparticles. There is ample experimental evidence that the resulting nanoparticle colloidal dispersions (known as nanofluids) affect the boiling heat transfer coefficient and, notably, enhance the CHF.

SUMMARY

According to methods that are further described, herein, a superhydrophilic thin film is formed on the metal surface of a boiler vessel to alter the wettability and roughness of the surface, which, in turn, changes the boiling behavior at the surface. The superhydrophilic film is formed by depositing a layer of a first ionic species on the surface from a solution. A second ionic species having a charge opposite to that of the first ionic species is then deposited from solution onto the surface to produce a bilayer of the first ionic species and the oppositely charged second ionic species. The depositions are then repeated to form a plurality of bilayers, each new bilayer on top of the preceding bilayer. The bilayers are then heated, leaving the second ionic species on the metal surface to form a superhydrophilic film.

Specifically, a wettability improvement at the surface is thought to be responsible for a CHF enhancement, while changes in surface roughness are thought to be responsible for changes in the heat-transfer coefficient. More specifically, the superhydrophilic film can delay (increase the value of) CHF, as it obstructs the coalescence of bubbles on the surface, thus inhibiting the transition to the film-boiling mode in which a thin layer of vapor, which has a low thermal conductivity, stretches across and insulates the surface. The greater surface roughness, on the other hand, promotes nucleate boiling, which is characterized by the growth and release of bubbles at discrete points on a heated surface with high rates of energy transport. The methods described herein afford substantial control over the deposition of the nanoparticles and, consequently, substantial and rigorous control over the physical-chemical properties of the coated surface.

The superhydrophilic film can have porosity of, e.g., about 40% to about 50% and an open interconnected pore network with an average pore diameter, e.g., of less than 150 nm (e.g., between 10 and 100 nm). The nanoporous texture of the film in combination with its chemical composition provide the superhydrophilicity (i.e., producing a water droplet contact angle less than 5° in less than 0.5 seconds). Though these results need not be tied to a particular theory, the superhydrophilicity of the film may be the product of the rapid infiltration (nanowicking) of a wettable three-dimensional interconnected nanoporous network. Use of the superhydrophilic thin films produced via these methods can result in more-compact heat exchangers, nuclear and chemical reactors, refrigeration and air-conditioning systems, etc.

BRIEF DESCRIPTION OF THE DRAWINGS

In the accompanying drawings, like reference characters refer to the same or similar parts throughout the different views. The drawings are not necessarily to scale, emphasis instead being placed upon illustrating particular principles, discussed below.

DETAILED DESCRIPTION

Figure 1:
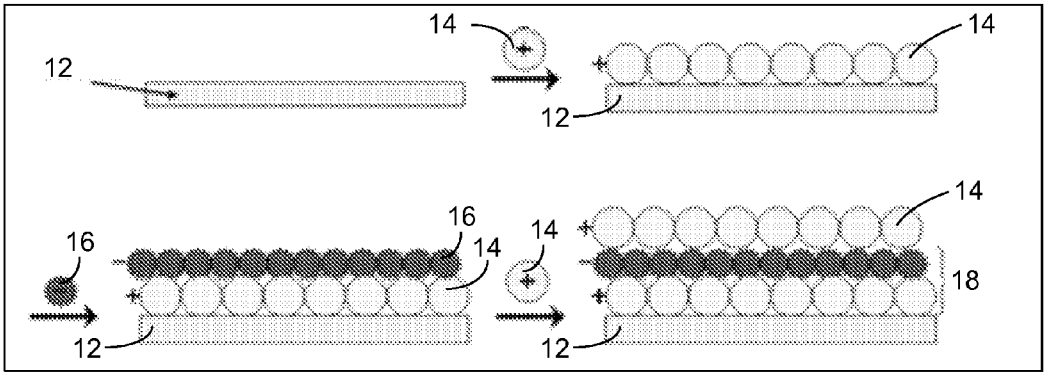
FIG. 1 schematically illustrates a sequence of stages wherein a substrate is coated with layers of cationic and anionic species.

The foregoing and other features and advantages of various aspects of the invention(s) will be apparent from the following, more-particular description of various concepts and specific embodiments within the broader bounds of the invention(s). Various aspects of the subject matter introduced above and discussed in greater detail below may be implemented in any of numerous ways, as the subject matter is not limited to any particular manner of implementation. Examples of specific implementations and applications are provided primarily for illustrative purposes.

Unless otherwise defined, terms (including technical and scientific terms) used herein have the same meaning as commonly understood by one of ordinary skill in the art to which this invention belongs. It will be further understood that terms, such as those defined in commonly used dictionaries, are to be interpreted as having a meaning that is consistent with their meaning in the context of the relevant art and are not to be interpreted in an idealized or overly formal sense unless expressly so defined herein. For example, if a particular composition is referenced, practical and imperfect realities may apply; e.g., the potential presence of at least trace impurities (e.g., at less than 0.1% by weight or volume) can be understood as being within the scope of the description; likewise, if a particular shape is referenced, the shape is intended to include imperfect variations from ideal shapes, e.g., due to machining tolerances.

Although the terms, first, second, third, etc., may be used herein to describe various elements, these elements are not to be limited by these terms. These terms are simply used to distinguish one element from another. Thus, a first element, discussed below, could be termed a second element without departing from the teachings of the exemplary embodiments.

Spatially relative terms, such as "above," "upper," "beneath," "below," "lower," and the like, may be used herein for ease of description to describe the relationship of one element to another element, as illustrated in the figures. It will be understood that the spatially relative terms are intended to encompass different orientations of the apparatus in use or operation in addition to the orientation depicted in the figures. For example, if the apparatus in the figures is turned over, elements described as "below" or "beneath" other elements or features would then be oriented "above" the other elements or features. Thus, the exemplary term, "above," may encompass both an orientation of above and below. The apparatus may be otherwise oriented (e.g., rotated 90 degrees or at other orientations) and the spatially relative descriptors used herein interpreted accordingly.

Further still, in this disclosure, when an element is referred to as being "on," "connected to" or "coupled to" another element, it may be directly on, connected or coupled to the other element or intervening elements may be present unless otherwise specified.

The terminology used herein is for the purpose of describing particular embodiments and is not intended to be limiting of exemplary embodiments. As used herein, the singular forms "a," "an" and "the" are intended to include the plural forms as well, unless the context clearly indicates otherwise. Additionally, the terms, "includes," "including," "comprises" and "comprising," specify the presence of the stated elements or steps but do not preclude the presence or addition of one or more other elements or steps.

Figure 6:
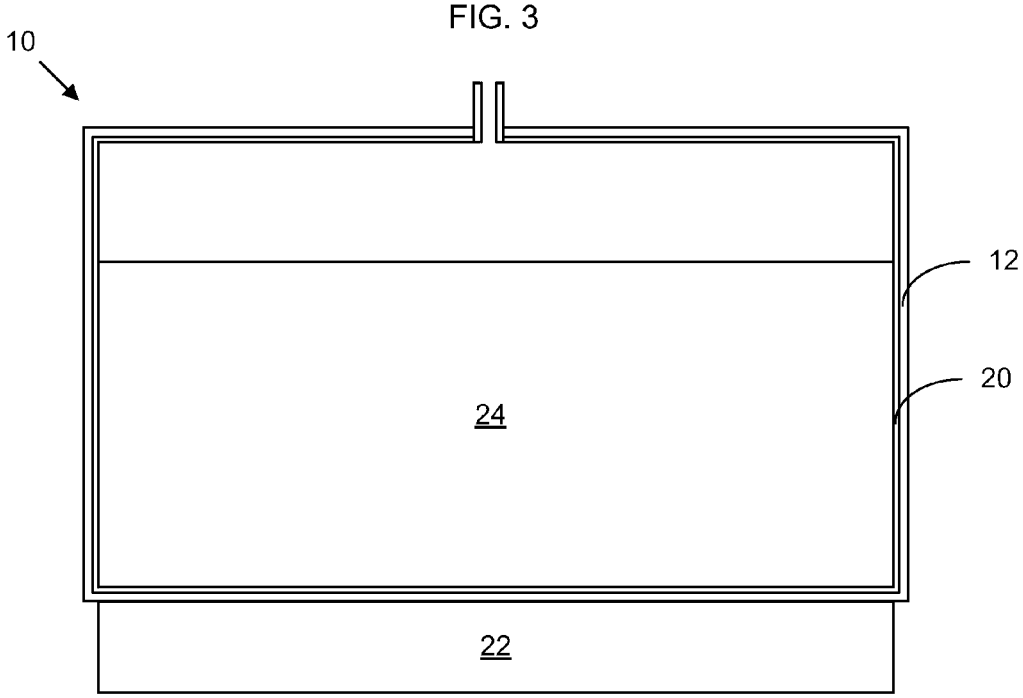
FIG. 6 is a schematic illustration of a boiler coated with a thin-film coating.

Described herein is a superhydrophilic film formed on an inner surface of a boiler vessel serving as the substrate 12, as shown in FIG. 6. The boiler vessel 12 is a closed vessel in which water 24 or another liquid is heated. A heat source 22 is provided to heat the boiler vessel 12 and thereby heat and vaporize the liquid 24 e.g., by burning fuel (such as wood, coal, oil or natural gas); nuclear fission; or from electric heating elements. The vaporized fluid exits the boiler 10 and can be used, for example, to provide steam power or heating. The boiler vessel 12 can be formed, e.g., of a metal, such as stainless steel, wrought iron, copper or brass.

The superhydrophilic film coated on the inner surface of the boiler vessel improves the critical value of the heat flux (CHF) at the inner surface of the boiler vessel. In operation, a liquid, such as water, is boiled in the vessel as heat from an energy source (e.g., wood, coal, oil, natural gas, chemical reactions or nuclear fission) is conducted through the vessel to the liquid, wherein boiling of the liquid is facilitated due to an improvement in the CHF provided by the superhydrophilic coating. A boiler with this improved surface coating can be utilized in a variety of applications; for example, the boiler can be used in a cooling system for electronic devices, nuclear or chemical reactors, or refrigeration systems; in other applications, the boiler can be used in heating systems or steam-power systems.

To demonstrate the efficacy of this method and the resulting structure, a layer-by-layer (LbL) assembly method was used to coat test wires and other substrates. The layer-by-layer technique can produce a conformal coating on a wide variety of substrates and allows for precise control over the thickness and architecture of the coating. An example of the layer-by-layer assembly method includes (a) immersing a substrate 12 in a bath containing a cationic species 14 (e.g., a positively charged polymer or nanoparticles) for, e.g., 15 minutes to coat the substrate 12 with an adsorbed cationic species 14 (e.g., a negatively charged polymer or nanoparticle), as is shown in FIG. 1; then (b) rinsing, e.g., three times with Milli-Q deionized water; and then (c) immersing the coated substrate in a bath containing an anionic species 16, which adsorbs to the cationic species 14, and again rinsing. This cycle creates one bilayer 18 of the cationic species 14 and anionic species 16, which can have a thickness, e.g., of about 10 to about 100 nm; and the cycle is then repeated a number of times (e.g., to form at least 10 bilayers or, in some cases, at least 14 bilayers) to assemble a coating of a desired thickness. The thickness of the resulting film can be, e.g., 500 nm or less; and the root mean square (rms) surface roughness can be, e.g., in the range of 10-20 nm.

In particular embodiments, a majority of both the cationic and ionic species are nanoparticles with a size (diameter) no greater than 100 nm. In additional embodiments, the anionic species comprises about 50% by weight silica ($SiO_2$) with a particle size of about 45-55 nm and about 50% by weight silica with a particle size of about 15-25 nm.

Figure 2:
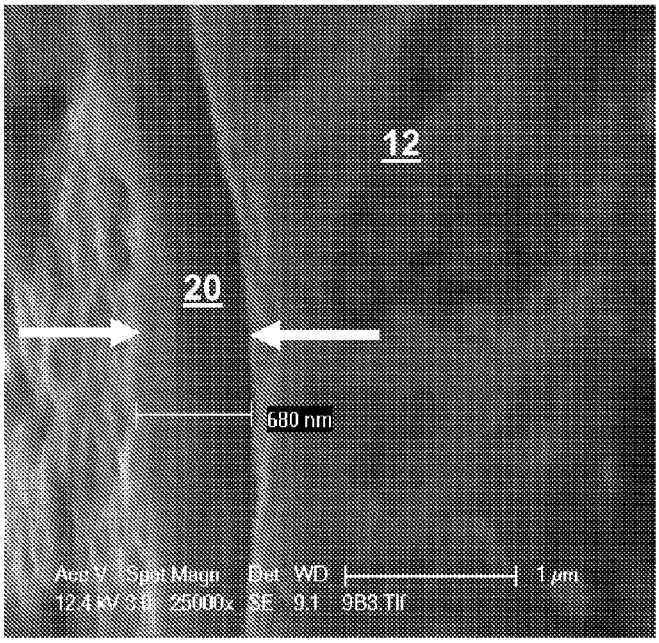
FIG. 2 is a magnified image of a PAH/$SiO_2$ thin film coated on a nickel wire via the layer-by-layer process.
Figure 3:
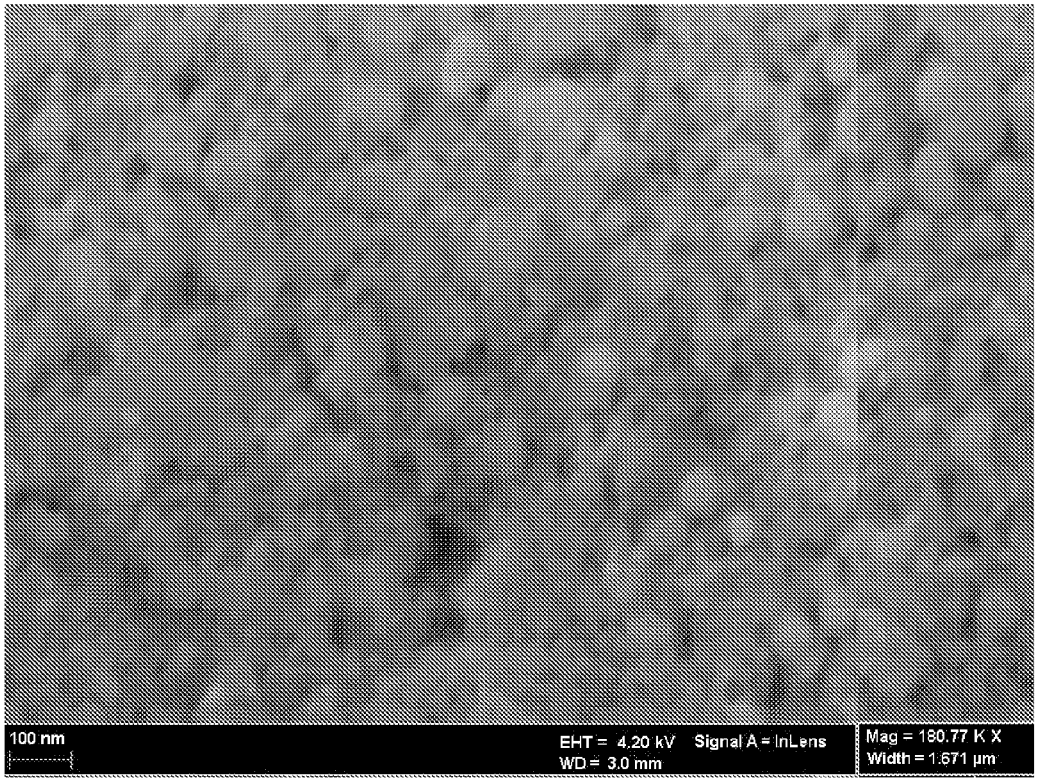
FIG. 3 is a highly magnified view of a 20-bilayer PAH/$SiO_2$ calcinated coating, including both approximately 50-nm-diameter $SiO_2$ particles and approximately 20-nm-diameter $SiO_2$ particles on a stainless steel substrate.

An image of a section of a somewhat thicker (i.e., 680 nm) nanoparticle thin-film coating 20 formed by the layer-by-layer process on a nickel wire, acting as the substrate 12 is shown in FIG. 2. The coating includes 20 calcinated bilayers of poly(allylamine hydrochloride) (PAH) as the cationic species and $SiO_2$ as the anionic species. A highly magnified view of another nanoparticle thin-film coating is shown in FIG. 3. This image shows a 20-bilayer PAH/$SiO_2$ calcinated coating on a stainless steel substrate. Note that the coating is very porous at the nanoscopic level, with both large spherical $SiO_2$ particles (having diameters of about 50 nm) and smaller $SiO_2$ particles (having diameters of about 20 nm) being constituents of the film.

In a series of tests, five bilayers of poly(allylamine hydrochloride) (PAH, available from Sigma Aldrich, St. Louis, Mo.) and sodium poly(styrene sulfonate) (SPS, available from Sigma Aldrich) were first deposited on a surface. Both were deposited from $10^{-2}$M dipping solutions adjusted to pH 4.0 with hydrochloric acid. These bilayers served to provide a known, uniform surface on which to deposit subsequent materials to ensure uniform deposition and good adhesion.

Bilayers of PAH were then deposited as the cationic species; and nanoparticles from a 0.06 wt % silica ($SiO_2$) nanoparticle suspension [containing an equal weight fraction of 50-nm-diameter silica nanoparticles (from Polysciences, Warrington, Pa.) and 20-nm-diameter silica nanoparticles (from Sigma Aldrich)] were deposited as the anionic species. The PAH solution was maintained at a pH of 7.5 by adding 1M aqueous sodium hydroxide. The $SiO_2$ nanoparticles were dispersed in a borate-based buffer (VWR) at a pH of 9.0. The resulting thickness of the coating was typically about 28 nm per bilayer. The number of bilayers was varied to achieve the desired thickness for different samples.

The layer-by-layer assembly process is driven by electrostatic interactions between the positively charged polycation (PAH) and the negatively charged silica ($SiO_2$) nanoparticles. Both PAH and the $SiO_2$ nanoparticles exhibit pH-dependent charge densities. In the case of the nanoparticles, the surface-charge density increases with increasing pH (due to ionization of surface silanol groups), whereas for PAH, the chain charge density decreases with increasing solution pH (due to deprotonation of ionized amine groups). The addition of salt to the dipping solutions can also be used to mediate the effective charge of these materials. As an alternative to, or in addition to, the silica nanoparticles, the deposited ionic species can include titania ($TiO_2$) and/or zirconia ($ZrO_2$). In other embodiments, the cationic species can include surface-functionalized silica (e.g., 3-Aminopropyl-functionalized silica nanoparticles).

After coating using the layer-by-layer process, some samples were heat-treated by placing them in a 550° C. furnace for four hours. At this temperature, the polymeric component of the coating is burned off, and the silica nanoparticles fuse together and bond to the substrate. The result is a significantly more hydrophilic surface due to the removal of the somewhat-hydrophobic PAH.

Co-inventors, Professor Michael F. Rubner and Professor Robert E. Cohen of the Massachusetts Institute of Technology, have provided additional description of techniques for forming nanoparticle coatings and the resulting structures in the following journal articles and published U.S. patent applications: D. Lee, et al., "Multilayers of Oppositely Charged $SiO_2$ Nanoparticles: Effect of Surface Charge on Multilayer Assembly," *Langmuir,* 23, 17, 8833-8837 (2007); L. Zhai, et al., "Patterned Superhydrophobic Surfaces: Toward a Synthetic Mimic of the Namib Desert Beetle," *Nano Letters,* 6, 6, 1213-1217 (2006); D. Lee, et al., "All-Nanoparticle Thin-Film Coatings," *Nano Letters,* 6, 10, 2305-2312 (2006); F. Cebeci, et al., "Nanoporosity-Driven Superhydrophilicity: A Means to Create Multifunctional Antifogging Coatings," *Langmuir,* 22, 6, 2856-2862 (2006); J. Bravo, et al., "Transparent Superhydrophobic Films Based on Silica Nanoparticles," *Langmuir* 23, 13, 7293 (2007); US patent application publication number 2007/0104922A1; US patent application publication number 2007/0166513A1; US patent application publication number 2008/0038458A1; and US patent application publication number 2008/0268229 A1.

In some embodiments, hydrophobic regions can be patterned on the superhydrophilic coating by, for example, micro-contact printing, photolithography, ink-jet printing, or micropipeting. Use of a combination of hydrophilic and hydrophobic regions on a surface can simultaneously raise the boiling heat transfer by promoting bubble nucleation at the hydrophobic sites and also raise the CHF by inhibiting formation of a continuous gas film across the surface during boiling.

Figure 4:
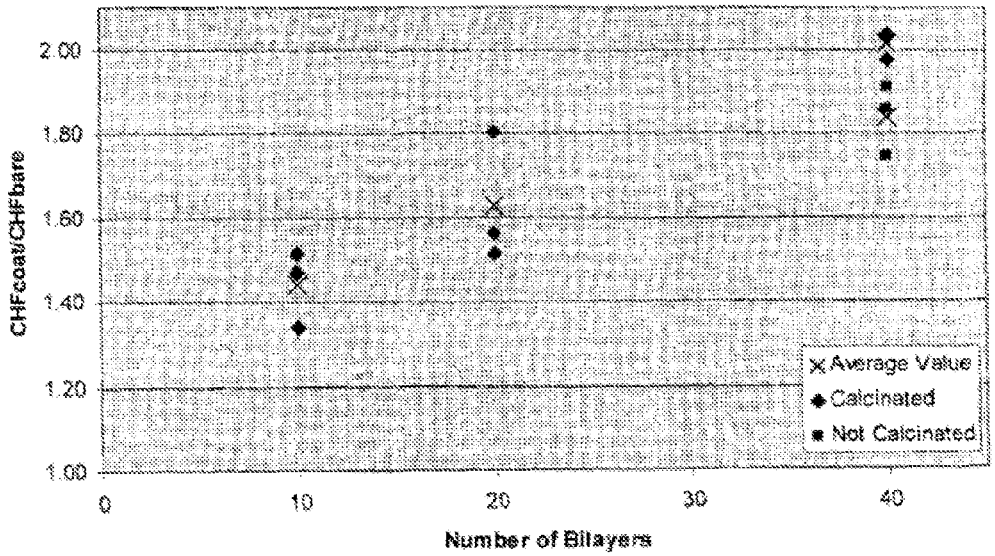
FIG. 4 is a plot showing enhancement of critical heat flux for 0.01-inch-diameter nickel wire coated with thin-film nanoparticle coatings (both calcinated and non-calcinated) in de-ionized water.
Figure 5:
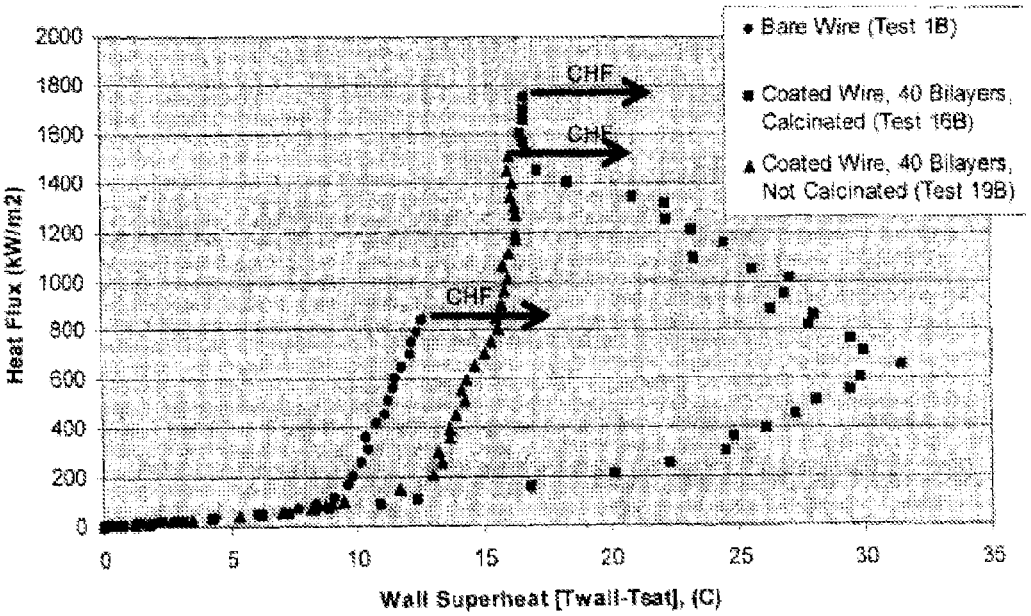
FIG. 5 is a plot showing boiling curves for 0.01-inch-diameter nickel wire in de-ionized water, wherein the wire samples include bare wire, coated and calcinated wire, and coated (but not calcinated) wire.

Surface coatings were prepared via the above-described layer-by-layer deposition process and tested in boiling rigs at Massachusetts Institute of Technology. The results are shown in FIGS. 4 and 5. In FIG. 4, CHF values for both calcinated coatings (represented by diamonds) and non-calcinated coatings (represented by squares) for a 0.01-inch-diameter nickel wire coated with thin-film nanoparticle coatings in de-ionized water are shown, and the CHF values for each test, along with the average values (represented by crosses) for each case, are provided.

Boiling curves for a 0.01-inch diameter nickel wire in de-ionized water is shown in FIG. 5. A test from the base, bare wire case (represented by circles) is plotted in addition to representative tests from two different coated wire cases, both calcinated (represented by squares) and non-calcinated (represented by triangles), each with 40 bilayers. Note that the CHF value is much higher for both coated cases, though the wall superheat is significantly increased for the calcinated 40-bilayer coated wire case. As shown in FIG. 5, the coatings can produce a CHF enhancement of up to 100%, and, in the case of non-calcinated coatings, results in minimal alteration of the boiling curve (i.e., minimal change of the boiling heat transfer coefficient).

While a 100% CHF enhancement with minimal change in the heat-transfer coefficient is a very significant performance improvement, per se, further improvement may be obtained. Briefly, the boiling heat transfer coefficient is roughly proportional to the number of microcavities present on the surface. To participate in the boiling process, these cavities are "active"—i.e., they contain a vapor/air pocket that serves as the 'embryo' of a bubble during the boiling process. Wettable cavities typically are not active. This process, however, can be used to create a surface with roughness in the micrometer range that has wettable "peaks" and non-wettable "valleys." This pattern can provide a high wettability for liquid macrolayers, which is advantageous for CHF enhancement, and, simultaneously, a network of non-wettable cavities that can serve as active bubble nucleation sites, which can promote a high heat-transfer coefficient.

In describing embodiments of the invention, specific terminology is used for the sake of clarity. For the purpose of description, specific terms are intended to at least include technical and functional equivalents that operate in a similar manner to accomplish a similar result. Additionally, in some instances where a particular embodiment of the invention includes a plurality of system elements or method steps, those elements or steps may be replaced with a single element or step; likewise, a single element or step may be replaced with a plurality of elements or steps that serve the same purpose. Further, where parameters for various properties are specified herein for embodiments of the invention, those parameters can be adjusted up or down by $1/100^{th}$, $1/50^{th}$, $1/20^{th}$, $1/10^{th}$, $1/5^{th}$, $1/3^{rd}$, 1/2, $3/4^{th}$, etc. (or up by a factor of 2, 5, 10, etc.), or by rounded-off approximations thereof, unless otherwise specified. Moreover, while this invention has been shown and described with references to particular embodiments thereof, those skilled in the art will understand that various substitutions and alterations in form and details may be made therein without departing from the scope of the invention. Further still, other aspects, functions and advantages are also within the scope of the invention; and all embodiments of the invention need not necessarily achieve all of the advantages or possess all of the characteristics described above. Additionally, steps, elements and features discussed herein in connection with one embodiment can likewise be used in conjunction with other embodiments. The contents of references, including reference texts, journal articles, patents, patent applications, etc., cited throughout the text are hereby incorporated by reference in their entirety. Appropriate components and methods of those references may be selected for the invention and embodiments thereof. Still further, the components and methods identified in the Background section are integral to this disclosure and can be used in conjunction with or substituted for components and methods described elsewhere in the disclosure within the scope of the invention. In method claims, where stages are recited in a particular order—with or without sequenced prefacing characters added for ease of reference—the stages are not to be interpreted as being temporally limited to the order in which they are recited unless otherwise specified or implied by the terms and phrasing.

What is claimed is:

1. A boiler comprising:

a boiler vessel for containing a liquid and having an interior metal surface; and a superhydrophilic film comprising anionic silica on the metal surface, wherein a majority of the silica has a particle size no greater than 100 nm, wherein the superhydrophilic film has an open interconnected pore network with an average pore diameter of less than 150 nm, and wherein the superhydrophilic film has (a) a surface roughness that increases wettability for liquid macrolayers so as to obstruct bubble coalescence on the superhydrophilic film and enhance critical heat flux from a heat source through the boiler vessel and the superhydrophilic film to the liquid and (b) a network of non-wettable cavities that serve as bubble nucleation sites so as to promote nucleate boiling and a high heat-transfer coefficient.

2. The boiler of claim 1, further comprising the heat source for heating the boiler vessel.

3. The boiler of claim 1, wherein the silica consists essentially of silica particles having a diameter of about 45-55 nm and silica particles having a diameter of about 15-25 nm.

4. The boiler of claim 3, wherein the weight fraction of the silica particles with the 45-55-nm diameter and the weight fraction of the silica particles with the 15-25-nm diameter are each about 50%.

5. The boiler of claim 1, further comprising a hydrophobic pattern on the superhydrophilic film.

6. The boiler of claim 1, wherein the superhydrophilic film has a porosity of about 40% to about 50%.

7. The boiler of claim 2, wherein the boiler vessel contains liquid in contact with the film.

8. The boiler of claim 7, wherein the liquid is water.

9. The boiler of claim 7, wherein the heat source and the superhydrophilic film are configured to transmit heat through the boiler vessel to generate nucleate boiling of liquid drawn through the open pore structure of the superhydrophilic film.

10. The boiler of claim 7, wherein of the superhydrophilic film has a structure that increases the critical value of the heat flux from the heat source to the liquid compared with that of the boiler vessel absent the superhydrophilic film.

11. The boiler of claim 10, wherein the structure of the superhydrophilic film increases the critical value of the heat flux by at least about 100%.

* * * * *

UNITED STATES PATENT AND TRADEMARK OFFICE

CERTIFICATE OF CORRECTION

PATENT NO. : 8,701,927 B2
APPLICATION NO. : 12/703228
DATED : April 22, 2014
INVENTOR(S) : Michael F. Rubner et al.

It is certified that error appears in the above-identified patent and that said Letters Patent is hereby corrected as shown below:

In the Claims

Col. 8, line 18, Claim 10, the term, "of", should be removed from between "wherein" and "the".

Signed and Sealed this
Twenty-ninth Day of July, 2014

Michelle K. Lee

Michelle K. Lee
*Deputy Director of the United States Patent and Trademark Office*